US006971374B2

(12) United States Patent
Saito

(10) Patent No.: US 6,971,374 B2
(45) Date of Patent: Dec. 6, 2005

(54) FUEL SUPPLY SYSTEM FOR OUTBOARD MOTOR

(75) Inventor: Chitoshi Saito, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/887,665

(22) Filed: Jul. 8, 2004

(65) Prior Publication Data

US 2005/0005915 A1 Jan. 13, 2005

(30) Foreign Application Priority Data

Jul. 8, 2003 (JP) ..... 2003-193577
Apr. 23, 2004 (JP) ..... 2004-128208

(51) Int. Cl.[7] ..... F02M 33/04
(52) U.S. Cl. ..... 123/516
(58) Field of Search ..... 123/516, 518, 123/519

(56) References Cited

U.S. PATENT DOCUMENTS 5,404,858 A 4/1995 Kato
5,598,827 A 2/1997 Kato
5,653,103 A 8/1997 Katoh
5,816,209 A 10/1998 Kato
5,819,711 A 10/1998 Motose
5,855,197 A 1/1999 Kato
5,865,160 A * 2/1999 Kato ..... 123/516
5,884,604 A 3/1999 Kato
5,890,472 A 4/1999 Saito
5,915,363 A 6/1999 Iwata et al.
5,924,409 A 7/1999 Kato
5,943,996 A 8/1999 Sogawa et al.
5,996,561 A 12/1999 Watanabe
6,006,705 A 12/1999 Kato et al.
6,067,966 A 5/2000 Saito et al.
6,279,546 B1 8/2001 Nakase et al.
6,321,711 B1 11/2001 Kato
6,346,018 B1 2/2002 Watanabe
6,575,145 B2 6/2003 Takahashi
6,662,786 B2 12/2003 Watanabe
6,698,401 B2 3/2004 Suzuki et al.
6,817,912 B1 * 11/2004 McChesney et al. ..... 440/88 N

* cited by examiner

*Primary Examiner*—Thomas Moulis
(74) *Attorney, Agent, or Firm*—Knobbe, Martens, Olson & Bear, LLP

(57) ABSTRACT

An outboard motor fuel vapor separator-venting system that vents fuel vapor from a fuel vapor separator through a vapor relief valve. The vapor relief valve is located in a high position on the outboard motor to ensure that liquid fuel does not reach the vapor relief valve. The vapor relief valve allows vapor to gradually be delivered from the vapor separator to an air induction system depending on the amount of air entering the air induction system and/or engine speed. The vapor relief valve does not allow fuel vapor to vent from the fuel vapor separator to the air induction system when the engine is not operating.

9 Claims, 5 Drawing Sheets

FUEL SUPPLY SYSTEM FOR OUTBOARD MOTOR

PRIORITY INFORMATION

This application is based on and claims priority to Japanese Patent Application No. 2003-193577, filed Jul. 8, 2003, and to Japanese Patent Application No. 2004-128208, filed Apr. 23, 2004, the entire contents of both applications are hereby expressly incorporated by reference.

BACKGROUND OF THE INVENTIONS

1. Field of the Inventions

The present inventions relate generally to a fuel vapor venting system for an outboard motor, and more particularly to a fuel vapor venting system that delivers fuel vapors from a vapor separator to an intake system.

2. Description of the Related Art

In the interest of improving emission control, many modern engines employ a fuel injection system for supplying fuel to the engine. The fuel injection systems can include a vapor separator.

The engines in outboard motors are operated often in a high speed and high load mode. The engine thus produces significant heat under such running conditions. In addition, such engines are generally enclosed in a protective cowling assembly and the heat can accumulate within the cowling. The ambient air around the engine, as a matter of course, is also heated. The fuel supply conduits, at least in part, extend within the protective cowling assembly and thus tend to absorb some heat from the engine.

Under some circumstances, bubbles or vapor can be formed in the fuel conduits and interfere with fuel flow therethrough, and thereby interfere with fuel injection control. Vapor lock can also occur in the fuel supply and/or fuel return conduits. If vapor lock occurs, the flow of fuel supply and/or return can be stopped, thereby causing the engine to stall.

SUMMARY OF THE INVENTIONS

In accordance with one embodiment, an outboard motor comprises a cowling, and an engine positioned within the cowling. The engine comprises a generally vertically extending crankshaft and an engine body comprising a combustion chamber, an air induction system, and a fuel system configured to provide fuel for combustion in the combustion chamber. The fuel system includes a vapor separator, the vapor separator including at least one conduit connected to a valve and configured to vent vapor to the air induction system through the valve. The valve is positioned at a generally same height or higher than all conduits that communicate with the valve and is configured to allow vapor to flow from the vapor separator to the air induction system when the engine is operating, and to prevent vapor from flowing from the vapor separator to the air induction system when the engine is not operating.

In accordance with another embodiment, an outboard motor comprises a cowling and an engine positioned within the cowling. The engine comprises a generally vertically extending crankshaft and an engine body comprising a combustion chamber, an air induction system, and a fuel system configured to provide fuel for combustion in the combustion chamber. The fuel system includes a vapor separator, the vapor separator including at least one conduit connected to a valve and configured to vent vapor to the air induction system through the valve. A mounting assembly is configured for supporting the outboard motor relative to an aft end of a watercraft and to allow the outboard motor to be tilted relative to the watercraft. The outboard motor also includes means for maintaining the valve at a position higher than the vapor separator when the outboard motor is tilted to a maximum tilted-up position.

BRIEF DESCRIPTION OF THE DRAWINGS

The foregoing features, aspects, and advantages of the present inventions will now be described with reference to the drawings of a preferred embodiment that is intended to illustrate and not to limit the inventions. The drawings comprise six figures in which.

DETAILED DESCRIPTION OF THE PREFERRED EMBODIMENT

Figure 1:
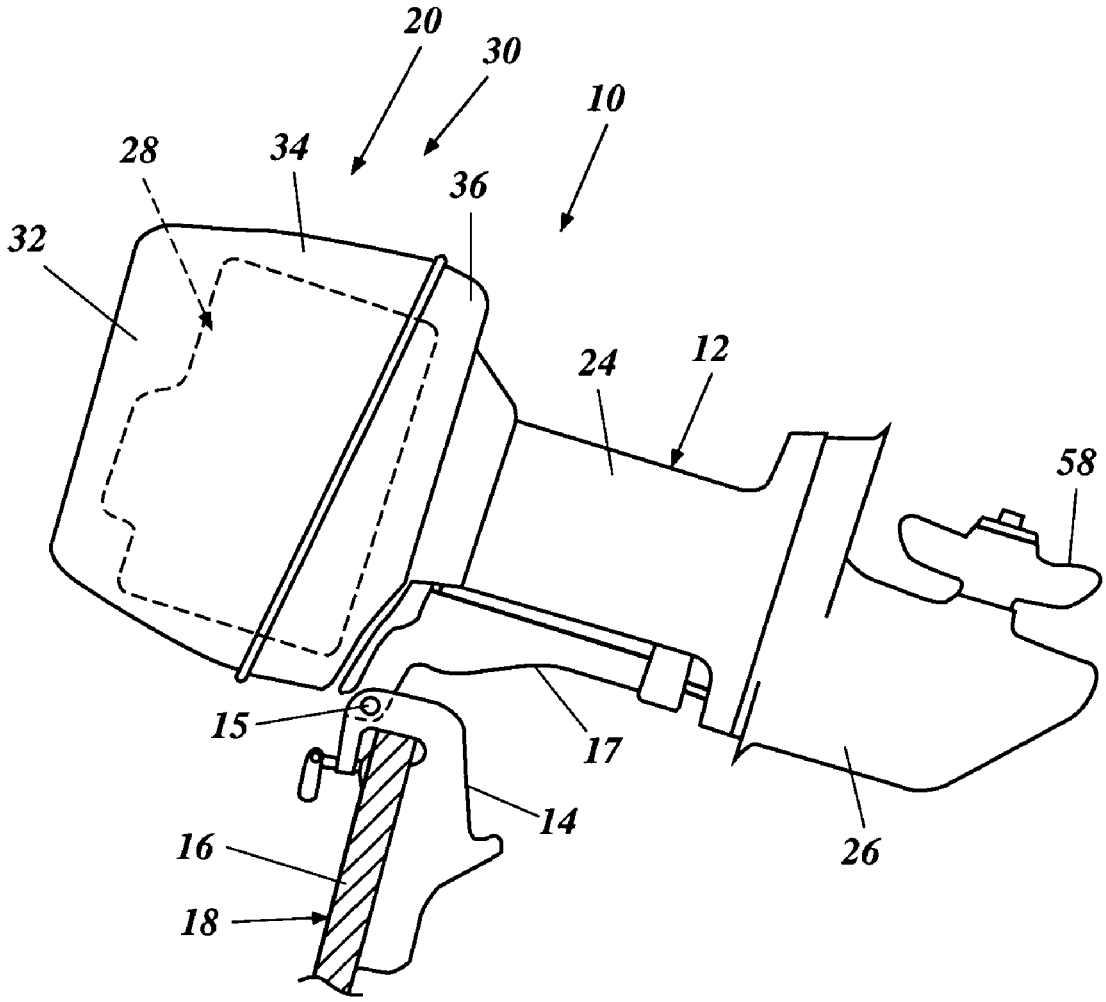
FIG. 1 is a side elevational view of an outboard motor in a tilted-up position and configured in accordance with a preferred embodiment, with an associated watercraft partially shown in section and an engine disposed therein illustrated in phantom line.
Figure 2:
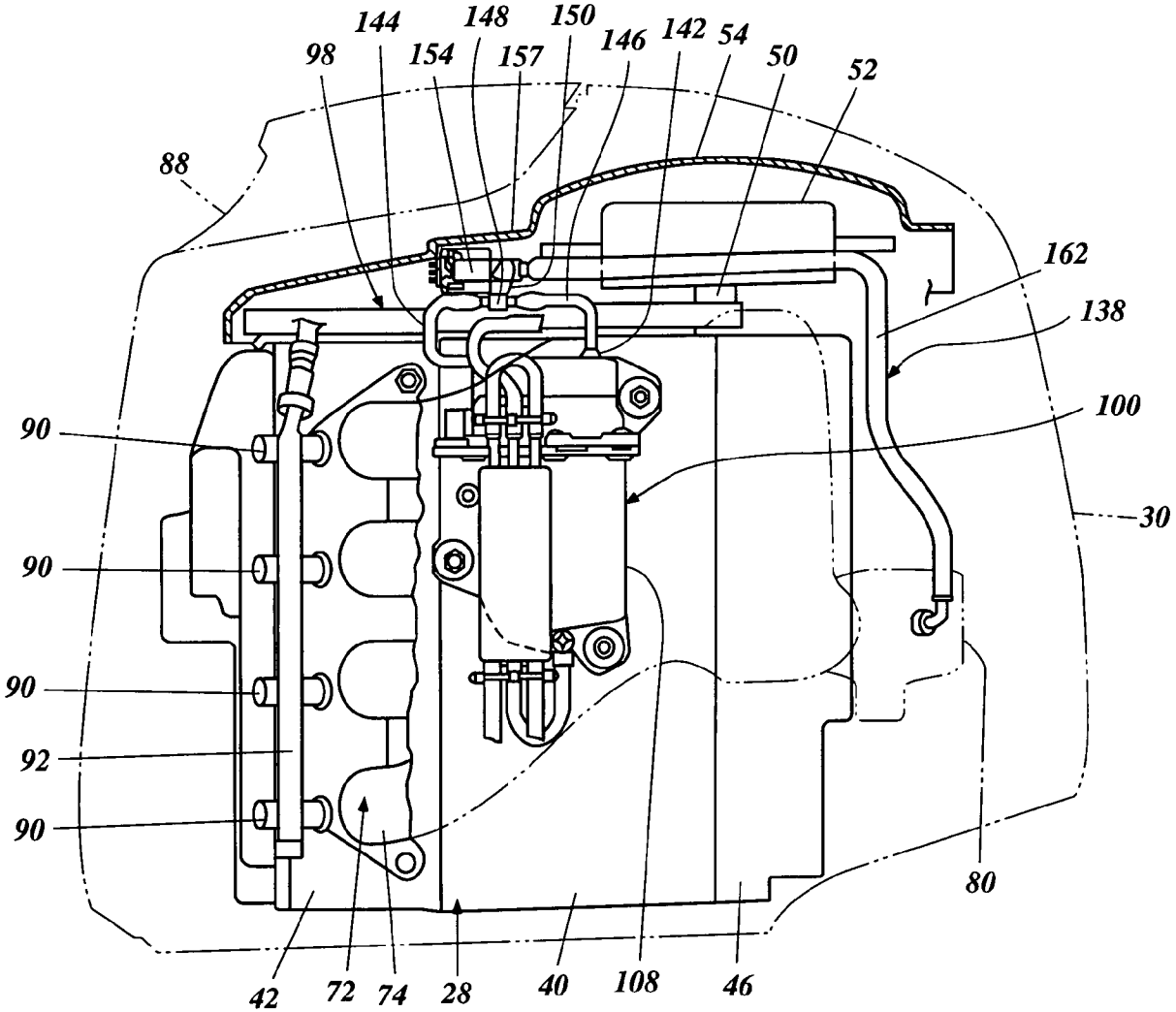
FIG. 2 is a side elevational and partial cut-away view of an upper section of the outboard motor shown in FIG. 1, with various parts of the engine shown in greater detail.
Figure 3:
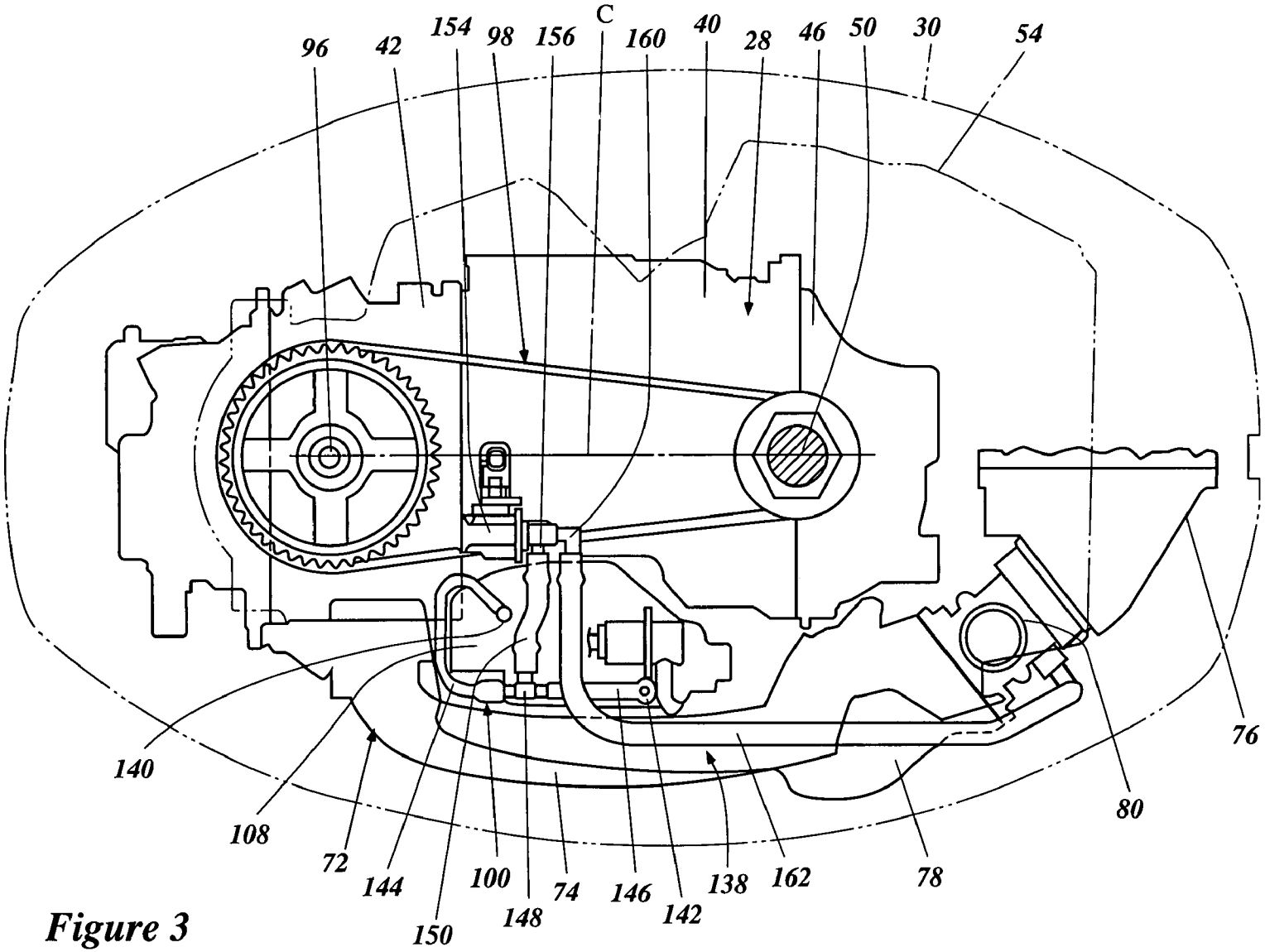
FIG. 3 is a top and partial cut-away view of the outboard motor of FIG. 1, with various parts of the engine shown in greater detail.

With reference to FIGS. 1–3, an outboard motor 10 includes a drive unit 12 and a bracket assembly 14. The bracket assembly 14 attaches the drive unit 12 to a transom 16 of an associated watercraft 18 and supports a marine propulsion device such as propeller 58 in a submerged position relative to a surface of a body of water. The bracket assembly 14 includes a pivot pin 15 that rotatably connects the bracket assembly 14 to a drive unit bracket 17.

As used to this description, the terms "forward," "forwardly," and "front" mean at or toward the side where the bracket assembly 14 is located, unless indicated otherwise or otherwise readily apparent from the context use. The terms "rear," "reverse," "backwardly," and "rearwardly" mean at or toward the opposite side of the front side.

The illustrated drive unit 12 includes a power head 20 mounted on top of drive unit 12. The drive unit 12 also includes a drive shaft housing 24 and the lower unit 26. The power head 20 includes an internal combustion engine 28 within a protective cowling assembly 30, which can be made of plastic or any material. The protective cowling assembly 30 typically defines a generally closed cavity 32 in which the engine 28 is disposed. The engine 28 is thereby is generally protected by the cowling assembly 30 from environmental elements.

The protective cowling assembly 30 includes a top cowling member 34 and a bottom cowling member 36. The top cowling member 34 can be detachably affixed to the bottom cowling member 36 by a suitable coupling mechanism to facilitate access to the engine and other related components.

The engine 28 in the illustrated embodiment preferably operates on a four-cycle combustion principle. With reference to FIG. 2, the illustrated engine 28 includes four cylinders arranged inline in the cylinder block 40. The cylinder block 40 thus defines a cylinder bank. In the illustrated arrangement, the cylinder bank has four cylinder bores. The cylinder bores of the bank extend generally horizontally and are generally vertically spaced from one another. This type of engine, however, merely exemplifies one type of engine that can be used with the inventions disclosed herein. Engines having other numbers of cylinders, having other cylinder arrangements (V, opposing, W, etc.), and operating on other combustion principles (e.g., crankcase compression, two-stroke, diesel, or rotary) can be used in other embodiments.

As used in this description, the term "horizontally" means that members or components extend generally parallel to the water surface (i.e., generally normal to the direction of gravity) when the associated watercraft 18 is substantially stationary with respect to the water surface and when the drive unit 12 is not tilted upwardly. The term "vertically" in turn means that proportions, members or components extend generally normal to those that extend horizontally.

A movable member, such as a reciprocating piston, moves relative to the cylinder block 40 in a suitable manner. In the illustrated arrangement, a piston (not shown) reciprocates within each cylinder bore. A cylinder head member 42 is fixed to a respective first end of the cylinder bank to close those ends of the cylinder bores. The cylinder head member 42 together with the associated pistons and cylinder bores provide four combustion chambers (not shown). Of course, the number of combustion chambers can vary, as indicated above.

A crankcase member 46 is coupled with the cylinder block 40. The crankcase member 46 and a crankcase cover member (not shown) close the other end of the cylinder bores and, together with the cylinder block 40, define a crankcase chamber.

A crankshaft 50 extends generally vertically through the crankcase chamber and is journaled for rotation about a rotational axis by several bearing blocks. A flywheel 52 is positioned below a front engine cover section 54 on the upper side of the engine 28. The flywheel 52 is connected to the upper side of the crankshaft 50. Connecting rods couple the crankshaft 50 with the respective pistons in any suitable manner. Thus, a reciprocal movement of the pistons rotates the crankshaft 50.

With reference again to FIG. 1, the driveshaft housing 24 depends from the power head 20 to support a drive shaft (not shown), which is coupled with crankshaft 50 and which extends generally vertically through driveshaft housing 24. The driveshaft is journaled for rotation and is driven by the crankshaft 50.

The lower unit 26 depends from the driveshaft housing 24 and supports a propulsion shaft (not shown) that is driven by the driveshaft through a transmission unit (not shown). A propulsion device is attached to the propulsion shaft. In the illustrated arrangement, the propulsion device is the propeller 58 that is fixed to the transmission unit. The propulsion device, however, can take the form of a dual counter-rotating system, a hydrodynamic jet, or any of a number of other suitable propulsion devices.

Preferably, at least three major engine portions 40, 42, and 46 are made of aluminum alloy. In some arrangements, the cylinder head cover member can be unitarily formed with the respective cylinder member 42. In addition, the crankcase cover member can be unitarily formed with the crankcase member 46.

The engine 28 also comprises an air induction system 72. The air induction system 72 guides air from within the cavity 32 to the combustion chambers. The air induction system 72 shown comprises an air intake silencer 76, a plenum chamber 78, and four intake passages 74. In the illustrated arrangement, the cylinder bank communicates with the four intake passages 74.

The most downstream portions of the intake passages 74 are defined within the cylinder head member 42 as inner intake passages. The inner intake passages communicate with the combustion chambers through intake ports, which are formed at inner surfaces of the cylinder head members 42.

Each of the combustion chambers can have one or more intake ports. Intake valves are slidably disposed at each cylinder head member 42 to move between an open position and a closed position. As such, the intake valves act to open and close the ports to control the flow of air into the combustion chamber. Biasing members, such as springs, are used to urge the intake valves toward their respective closed positions by acting between a mounting boss formed on each cylinder head member 42 and a corresponding retainer that is affixed to each of the valves. When an intake valve is in the open position, the respective inner intake passage communicates with the associated combustion chamber through the associated intake port.

Other portions of the intake passages 74, are disposed outside of the cylinder head members 42. The respective intake passages 74 extend forwardly alongside surfaces of the engine 28 on the starboard side from the respective cylinder head member 42 to the front of the crankcase cover member. The intake passages 74 extend generally horizontally and parallel to each other, and are vertically spaced apart from one another.

In the illustrated arrangement, the air induction system 72 comprises a throttle body 80, in which a throttle valve 82 (FIG. 4) is positioned. The throttle body 80 preferably includes the throttle valve 82. Preferably, the throttle valve 82 can be a butterfly valve that has valve shafts journaled for pivotal movement about generally an axis, although other types of valves can be used.

In some arrangements, the valve shaft is linked and is connected to a control linkage. The control linkage is connected to an operational member, such as a throttle lever, that is provided on the watercraft or otherwise proximate the operator of the watercraft 18. The operator can control the opening degree of the throttle valve 82 in accordance with operator request through the control linkage. Optionally, the throttle valve 82 can be controlled electronically.

Regardless of how the throttle valve is controlled, the throttle valve 82 can meter or regulate amounts of air that flow through intake passages 74 through the combustion chambers in response to the operation of the operational member by the operator. Normally, the greater the opening degree of the throttle valve 82, the higher the rate of airflow and the higher the engine speed.

Induction air can bypass the throttle body 80 through an idle speed control valve (ISC) 84 that can be controlled by an electronic control unit (ECU) 86. The ECU 86 can control engine speed by providing additional or less air to the engine 28 through the idle speed control valve 84. Further functions of the ECU 86 are described below.

During operation, air enters the closed cavity 32 through an air inlet 88. The air within the closed cavity 32 is drawn into the intake system 72 and then enters the outer intake passages 74. The throttle valve 82 regulates the level of airflow and the air passes through the outer intake passage 74.

The engine 28 further includes an exhaust system that routes burnt charges, i.e., exhaust gases, to a location outside of the outboard motor 10. The cylinder head member 42 defines a set of inner exhaust passages that communicate with the combustion chambers through one or more exhaust ports defined at the inner surfaces of the respective cylinder head members 42. The exhaust ports can be selectively opened and closed by exhaust valves. The construction and arrangement of the exhaust valves are substantially the same as the construction and arrangement of the intake valves. Thus, further description of these components is unnecessary.

An exhaust manifold preferably extends generally vertically. The exhaust manifold can be a separate member or can be partially or wholly defined by the cylinder block 40. The exhaust manifold communicates with the combustion chambers through the inner exhaust passages and the exhaust ports to collect the exhaust gas therefrom. When the exhaust ports are opened, the combustion chambers communicate with an exhaust discharge passage through the exhaust manifold.

In the embodiment of FIG. 1, the driveshaft housing 24 defines an internal section of the exhaust system that guides a majority of the exhaust gases to the lower unit 26. The internal section includes an idle discharge portion that extends from a main portion of the internal section to discharge idle exhaust gases directly to the atmosphere through a discharge port that is formed on a rear surface of the driveshaft housing 24.

The lower unit 26 also defines an internal section of the exhaust system that is connected with the internal exhaust section of the driveshaft housing 24. At engine speeds above idle, the exhaust gases are generally discharged to the body of water surrounding the outboard motor 10 through the internal sections and a discharge section defined within the hub of the propeller 58.

A valve cam mechanism preferably is provided for actuating the intake and exhaust valves. In the embodiment shown, the valve cam mechanism includes a rotatable member such as a camshaft 96. The camshaft 96 is driven by the crankshaft 50 at half the crankshaft speed by a flexible member 98. The crankshaft 50 and the camshaft 96 are generally aligned along a centerline C. The camshaft 96 extends generally vertically and is journaled for rotation between the cylinder head member 42 and the cylinder head cover members.

The camshaft 96 has cam lobes (not shown) to push valve lifters (not shown) that are fixed to the respective ends of the intake and exhaust valves in any suitable manner. Cam lobes repeatedly push the valve lifters at a timing in proportion to the engine speed. The movement of the lifters generally is dictated by rotation of the camshaft 96 to appropriately actuate the intake and exhaust valves.

A throttle valve position sensor 99 preferably is arranged proximate the throttle body 82 in the illustrated arrangement. The sensor 99 preferably is configured to generate a signal that is representative of either absolute throttle position or movement of the throttle shaft. Thus, the signal from the throttle valve position sensor 99 can be used as an indication of engine load, and may be expressed as the degree of throttle opening.

In some applications, a manifold pressure sensor 101 can also be provided to detect engine load. Additionally, an induction air temperature sensor 102 can be provided to detect induction air temperature. The signal from the sensors can be sent to the ECU via respective data lines. These signals, along with other signals, can be used to control various aspects of engine operation, such as, for example, but without limitation, fuel injection amount, fuel injection timing, ignition timing and the like.

In order to determine appropriate engine operation control scenarios, the ECU preferably uses control maps and/or indices stored within the ECU in combination with data collected from various input sensors. The ECU's various input sensors can include, but are not limited to, the throttle position sensor 99, the manifold pressure sensor 101, the induction air temperature sensor 102, an engine coolant temperature sensor 103, an oxygen ($O_2$) sensor (not shown), an oil pressure sensor 104, a crankshaft speed sensor 106, and a neutral switch 114, etc.

The illustrated engine 28 further includes a fuel system 100 that comprises an indirect, port or intake passage fuel injection system. The illustrated fuel injection system shown includes four fuel injectors 90 with one fuel injector allotted to each one of the respective combustion chambers.

In the illustrated embodiment, each of the fuel injectors 90 communicate with a fuel delivery line 92. Each fuel injector 90 has an injection nozzle directed toward the downstream direction within the associated intake passage 74. The injection nozzle preferably is disposed downstream of the throttle valve 82. The fuel injectors 90 spray fuel into the intake passages 74 under control of the ECU 86. The ECU 86 is powered by a battery 91 through a main switch 93. The ECU 86 controls the initiation, timing and the duration of the fuel injection cycle of the fuel injector 90 so that the nozzle spray a desired amount of fuel for each combustion cycle.

Figure 4:
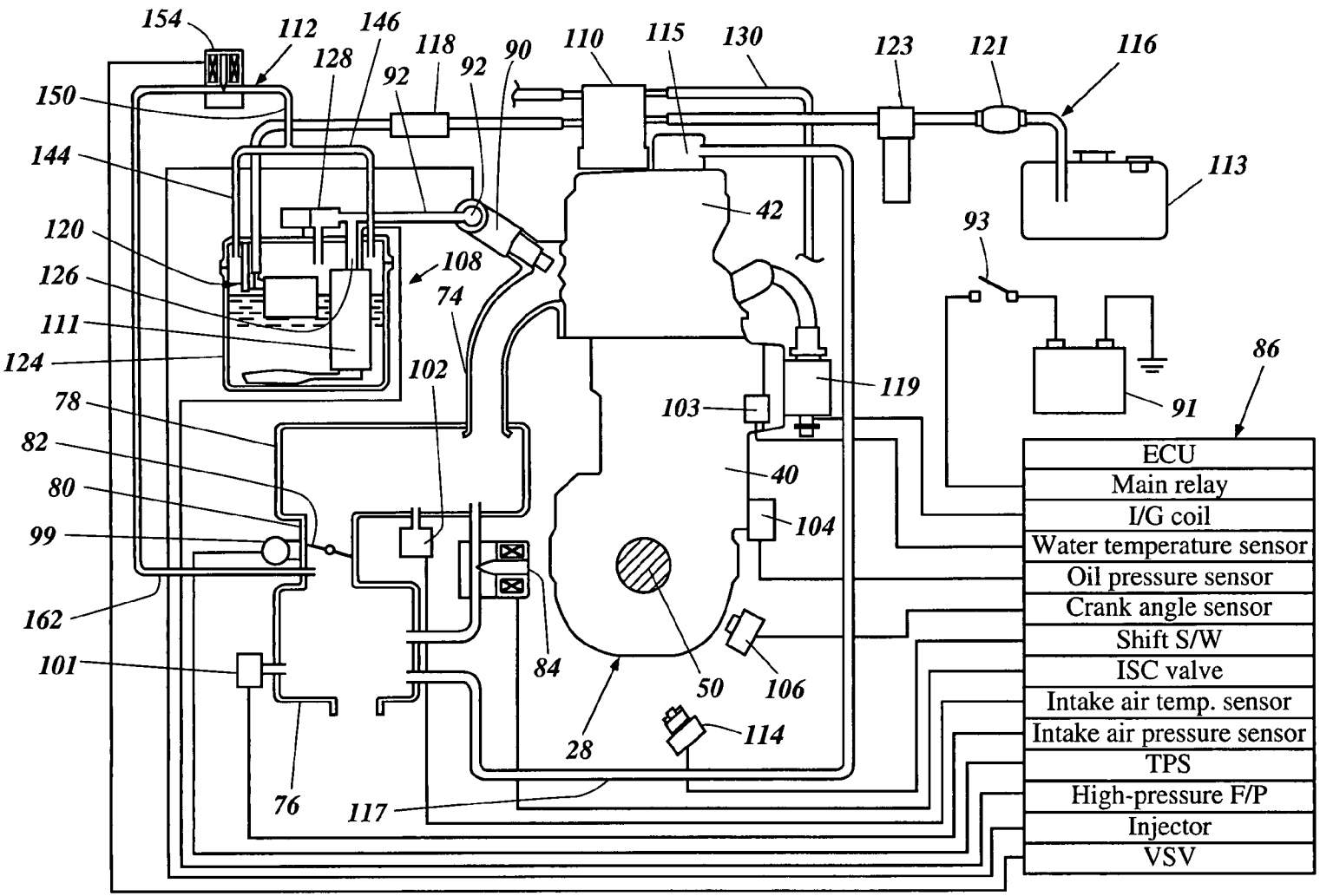
FIG. 4 is a schematic diagram of the engine including various systems including a fuel system, a controller, a fuel tank, fuel pumps, a vapor separator, and a cooling system.

With reference to FIG. 4, the fuel system 100 further includes a vapor separator 108 that is preferably in fluid communication with a fuel tank 113 and can be disposed along the intake passages 74 in one arrangement. The vapor separator 108 separates vapor from the fuel and can be mounted on the engine 28. The vapor separator 108 along with a fuel cooling system 109 is described in greater detail below.

The fuel injection system can employ one or a plurality of fuel pumps to deliver the fuel to the vapor separator 108 and to discharge the fuel therefrom. More specifically, in the illustrated arrangement, a lower pressure pump 110 pressurizes the fuel toward the vapor separator 108 and the high pressure pump 111, which is disposed within the vapor separator 108, pressurizes the fuel discharged from the fuel separator 108.

With continued reference to FIG. 4, a fuel vapor delivery system 112 couples the vapor separator 108 with a portion of the intake system 72, such as for example, but without limitation, the throttle body 80. The fuel vapor removed from the fuel supply by the vapor separator 108 thus can be delivered to the intake system 72 for delivery to the combustion chambers with the combustion air. The engine 28 is also provided with a breather 115 and a breather conduit 117 arranged to send lubricant vapor to the intake system 72. The fuel vapor delivery system 112 is described in greater detail below.

The engine 28 further includes an ignition system. Each combustion chamber is provided with a spark plug (not shown). Each spark plug has electrodes that are exposed in the associated combustion chamber. An ignition coil 119 that is controlled by the ECU 86 provides a high voltage to the spark plugs. The spark plugs generate a spark between the electrodes from the high voltage to ignite an air/fuel charge in the combustion chamber according to desired ignition timing maps or other forms of controls.

Generally, during an intake stroke, air is drawn into the combustion chambers through the air intake passages 74 and fuel is mixed with the air by the fuel injectors 90. The mixed air/fuel charge is introduced to the combustion chambers. The mixture is then compressed during the compression stroke. Just prior to or at the beginning of a power stroke, the respective spark plugs ignite the compressed air/fuel charge in the respective combustion chambers. The air/fuel charge rapidly burns during the power stroke to move the pistons. The burnt charge, i.e., exhaust gases, is then discharged from the combustion chambers during an exhaust stroke.

The illustrated engine 28 further comprises a lubrication system to lubricate the moving parts within the engine 28. The lubrication system is a pressure fed system where the correct pressure is important to adequately lubricate the bearings and other rotating surfaces. The lubrication oil is taken from an oil reservoir (not shown) and delivered under pressure throughout the engine to lubricate the internal moving parts.

The engine 28 can include other systems, mechanisms, devices, accessories, and components other than those described above such as, for example, a cooling system. The crankshaft 50 through the flexible transmitter 98 can directly or indirectly drive those systems, mechanisms, devices, accessories, and components.

The engine coolant temperature sensor 103 preferably is positioned to sense the temperature of the coolant circulating through the engine 28. Of course, the sensor could be used to detect the temperature in other regions of the cooling system; however, by sensing the temperature proximate the cylinders of the engine, the temperature of the combustion chamber and the closely positioned portions of the induction system is more accurately reflected.

It should be noted that the above-identified sensors merely correspond to some of the sensors that can be used for engine control and it is, of course, practicable to provide other sensors, such as a knock sensor, a neutral sensor, a watercraft pitch sensor, and an atmospheric temperature sensor. The selected sensors can be provided for sensing engine running conditions, ambient conditions or other conditions of the engine 12 or associated watercraft 10.

With reference to FIG. 4, a schematic diagram illustrates the fuel injection system. The fuel injection system includes the vapor separator 108, the fuel vapor delivery system 112, and the fuel cooling system 109 to cool the fuel that circulates from the vapor separator 108.

During operation, fuel is initially drawn by the low-pressure fuel pump 110 through a fuel tank conduit 116. The fuel passes through a primary hand pump 121, through a water separator 123, and through a fuel filter 118 before entering the vapor separator 108. The amount of fuel stored in the vapor separator 108 is regulated according to a predetermined amount of fuel measured by a float mechanism 120 before entering a vapor separator tank 124.

The fuel is delivered from the vapor separator tank 124 by the high-pressure fuel pump 111 through a high-pressure pump outlet 126 through the fuel delivery line 92 to each fuel injector 90. A fuel pressure regulator 128 regulates the fuel pressure inside the fuel delivery line 92.

Fuel inside the vapor separator tank 124 is kept at a predetermined temperature through the fuel cooling system 109. Fuel that passes through the pressure relief valve 128 circulates through the fuel cooling system 109 before returning to the vapor separator 108.

The fuel cooling system 109 comprises a heat exchanger that transfers the heat from the fuel to the cooling system 109. When brought into thermal communication with the fuel, the fuel cooling system 109 transfers heat away from the fuel allowing the fuel in the vapor separator 108 to remain at approximately a predetermined temperature. The cooling system 109 can use air, cooling water, or other fluids for cooling purposes. The low pressure fuel pump 110 can also be cooled through a cooling conduit 130 that communicates with the engine cooling system, the fuel cooling system 109, or a separate cooling system.

In one preferred embodiment, the cooling water is used to cool the fuel and can be directed to in the fuel cooling system 109 through an open-loop cooling system or a closed-loop cooling system. The cooling system 109 can be a separate cooling system designed only to specifically cool the fuel in the vapor separator tank 124 or the cooling system 109 can be part of another cooling system of the outboard motor 10. For example, the cooling system 109 can be a subpart of a cooling system for cooling the engine 28. Such a cooling system can be an open or closed loop type.

The vapor separator 108 separates vapor from the fuel and allows vapor to accumulate in an upper portion of the vapor separator tank 124. The vapor can be advantageously vented from the upper portion of the vapor separator 108 by a fuel vapor venting system 138.

Fuel vapor is delivered from the vapor separator 108 through vapor fittings 140, 142 that are connected to first and second vapor conduits 144, 146 respectfully. The vapor conduits 144, 146 are connected together by a T-shaped fitting 148. The T-shaped fitting 148 guides the vapor from the vapor conduits 144, 146 through a third vapor conduit 150 to a filter 152. The filter 152 assures that the vapor is free from any contaminants before entering a vapor relief valve or vapor solenoid valve (VSV) 154 through fourth vapor conduit 156. The vapor relief valve 154 is advantageously positioned below a rear engine cover section 157 to protect the valve 154 from any water that can enter cowling assembly 30.

In one preferred embodiment a solenoid 158 (FIG. 4) is controlled by the ECU 92 for manipulating vapor flow. The solenoid 158 is configured to activate the vapor relief valve 154 when a signal is received from the ECU 92. When the solenoid 158 is activated by the ECU 92, the vapor relief valve 154 is opened. The opened vapor relief valve 154 allows the vapor is to travel from the vapor relief valve 154 through a fitting 160 that connects to a vapor conduit 162. The vapor conduit 162 guides the fuel vapor to the throttle body 80 or the air induction system 72 where the vapor is advantageously introduced to the combustion chambers.

The vapor relief valve 154 is preferably positioned at a point that allows fuel vapor to rise toward the vapor relief valve 154 regardless of the tilt angle of the outboard motor 20. For example, when the outboard motor 20 is in a normal operating position, the vapor relief valve 154 is positioned above the vapor conduits 144, 146, the T-shaped fitting 148, the third vapor conduit 150, the filter 152, and the fourth vapor conduit 156. Positioning the vapor relief valve 154 above all the vapor conduits allows fuel vapor to rise toward the vapor relief valve 154 when the outboard motor is in the normal operating position. When the outboard motor 20 is in the tilted position as illustrated in FIG. 1, the vapor relief valve 154 remains in a position above all the vapor conduits. This position of the vapor relief valve 154 above all the vapor conduits allows fuel vapor to rise toward the vapor relief valve 154 when the outboard is in the tilted position.

A further advantage is provided where the valve 154 is positioned at the rearward side of the vapor separator 108. For example as shown in FIG. 2, the valve 154 is positioned at about the rearward edge of the vapor separator 108. As such, the valve 154 can be mounted close to the top of the vapor separator 108, and remain above the separator 108 when tilted forwardly (towards the right-hand side of FIG. 2).

Figure 5:
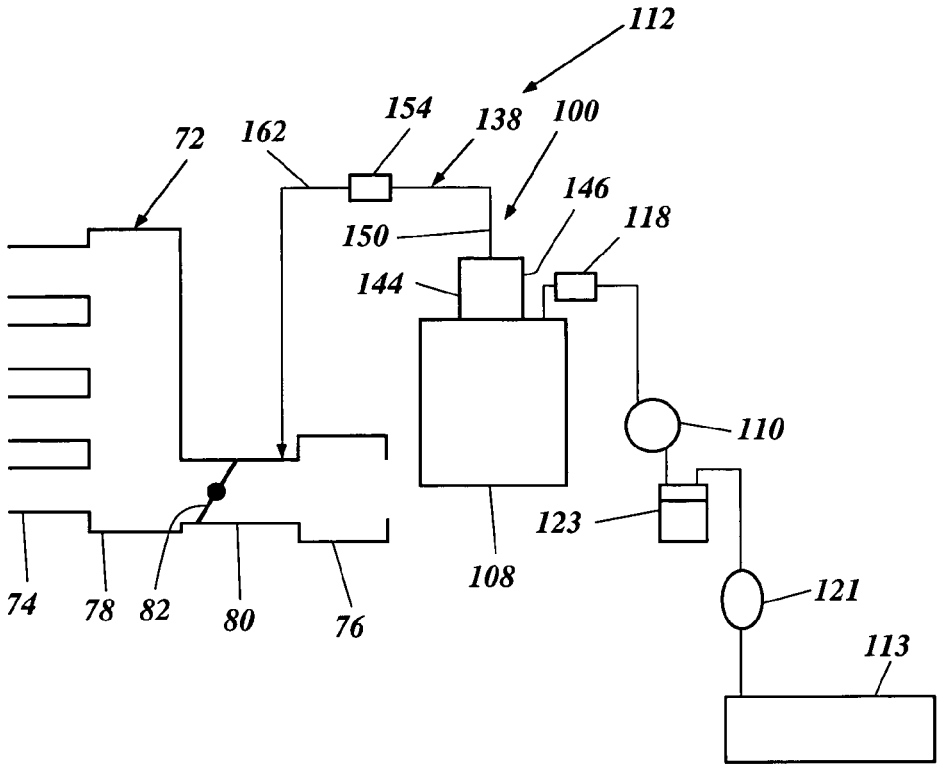
FIG. 5 is a schematic diagram of an intake system and the fuel system including a fuel tank, fuel pumps, and a vapor separator that can be used with the outboard motor of FIG. 1.

With reference to FIG. 5, the schematic diagram of the fuel vapor delivery system is illustrated. The schematic diagram shows the orientation of the fuel vapor delivery components with relation to the fuel tank 113 and the air induction system 72. The fuel vapor relief valve 154 remains in the highest position above all other fuel related components regardless if the outboard motor 28 is in the normal operating position or if the outboard motor 28 is in the tilted position. The highest position of the fuel vapor relief valve 154 assures that all fuel vapor that accumulates in the vapor separator 108 travels toward the vapor relief valve 154.

This position of the fuel vapor relief valve 154 allows the ECU 86 to actuate the solenoid 158 at predetermined intervals, without regard to the tilt angle of the outboard motor 10. The predetermined intervals or duty cycle of the solenoid 158 allows proportional control of the amounts of fuel vapor passing through the vapor relief valve 154 and into the air induction system 72. The predetermined duty cycles of the solenoid 158 and hence the predetermined varying amounts of fuel vapor, can be controlled so as to correspond to an operational state of the engine 28.

Figure 6:
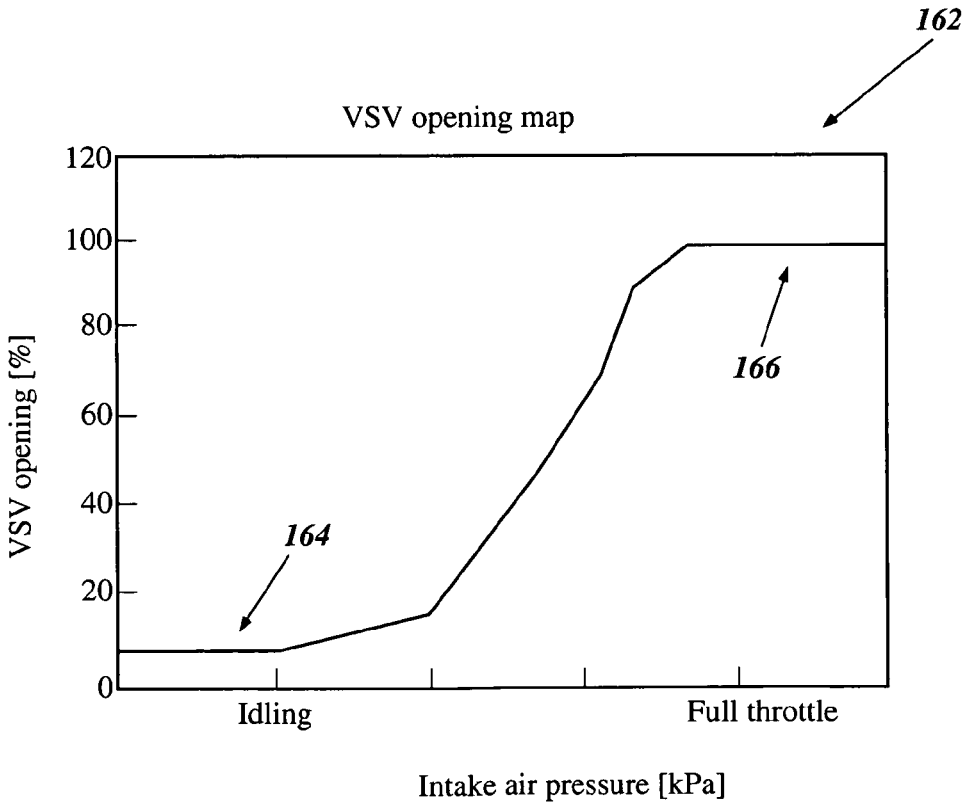
FIG. 6 is a two-dimensional graph illustrating a vapor separator vent valve-opening percentage (vertical axis) with respect to an intake pressure (horizontal axis).

FIG. 6 includes a graph that represents a data map 162 that provides data for operating the vapor relief valve 154 in accordance with a detected air pressure inside the air induction system 72. Preferably, the map 162 provides a relationship in which the amount of fuel vapor that is permitted to enter the air induction system 72 does not greatly affect a target air/fuel ratio for combustion in the combustion chambers. The amount of fuel vapor allowed to enter the air induction system 72 is based on the amount of air that is entering the combustion chambers. For example, the less air that is entering the combustion chambers, the less fuel vapor is permitted to enter the air induction system 72 so that the predetermined air/fuel ratio is not excessively affected.

At an idle throttle opening 164, the air pressure inside the plenum chamber 78 is low, and thus, the opening of the vapor relief valve 154 is minimal, thereby allowing smaller amounts of air to enter the combustion chambers of the engine 28. When only small amounts of air are entering the combustion chambers, the amounts of fuel vapor allowed to pass to the induction system 72 should be kept small because the predetermined air/fuel ratio set by the ECU 86 could be disturbed.

Thus the ECU 86, at the idle throttle opening 164, preferably is configured to control the vapor relief valve 154 so as to allow a smaller predetermined amount of fuel vapor into the air induction system 72, for example, as dictated by the map 162. Additionally, the map 162 dictates that as the throttle opening increases, the opening of the throttle relief valve 154 increases and the amount of fuel vapor permitted to enter the air intake system also increases.

As such, the amounts of fuel vapor entering the air induction system 72 do not greatly affect the predetermined air/fuel ratio set by the ECU 86. At a full throttle position 166, the opening of the vapor relief valve 154 is completely opened and a maximum predetermined amount of fuel vapor is permitted to enter the air induction system 72. When the throttle position is open completely and the vapor relief valve 154 is permitting the maximum predetermined amount of fuel vapor into the air induction system 72, the predetermined air/fuel ratio is not greatly affected.

A further advantage is provided where, upon starting of the engine 28, the vapor relief valve 154 is opened gradually, thereby allowing the accumulated vapor, which can be at an elevated pressure, to be released more slowly into the induction system. As such, an excessive amount of fuel vapor is not quickly drawn into the combustion chambers. This results in easier starting of the engine 28.

By keeping the fuel vapor separator 108 sealed with the vapor relief valve 154, fuel vapor emissions can be controlled. At the appropriate engine speed and engine load, the internal volume of the vapor separator 108 can vented under control of the vapor relief valve 154. This vapor separator venting control allows for a reduction in emissions and a gradual delivery of fuel vapor to the combustion chambers. When the outboard motor remains stationary after being operated, heat accumulates underneath the cowling assembly 30 and increases the temperature of the vapor separator 108. This increase in temperature increases the fuel pressure inside the vapor separator, however, the fuel vapor is kept inside the vapor separator 108, thereby causing the pressure to rise significantly. When the engine 28 is started, the vapor relief valve 154 gradually releases the fuel vapor to the air induction system 72.

An additional advantage is provided where the air/fuel mixture is provided with a substantially equal percentage of fuel vapor, or gaseous fuel, over substantially the entire range of engine speeds and or loads. As such, fuel control devices can more easily compensate for the additional fuel provided to the induction system in the vaporous form.

Although the present invention has been described in terms of a certain preferred embodiments; other embodiments apparent to those of ordinary skill in the art also are within the scope of this invention. Thus, various changes and modifications may be made without departing from the spirit and scope of the invention. For instance, not all of the features, aspects and advantages are necessarily required to practice the present invention. Accordingly, the scope of the present invention is intended to be defined only by the claims that follow.

What is claimed is:

1. An outboard motor comprising a cowling, an engine positioned within the cowling, the engine comprising a generally vertically extending crankshaft and an engine body comprising a combustion chamber, an air induction system, a fuel system configured to provide fuel for combustion in the combustion chamber, the fuel system including a vapor separator, the vapor separator including at least one conduit connected to a valve and configured to vent vapor to the air induction system through the valve, the valve being positioned at a generally same height or higher than all conduits that communicate with the valve, the valve being configured to allow vapor to flow from the vapor separator to the air induction system when the engine is operating, and to prevent vapor from flowing from the vapor separator to the air induction system when the engine is not operating.

2. The outboard motor of claim 1 additionally comprising a controller configured to vary an opening of the valve in response to changes in an amount of air flowing through the induction system.

3. The outboard motor of claim 2 additionally comprising an intake pressure sensor, wherein the controller is configured to detect the amount of air flowing through the induction system with the intake pressure sensor.

4. The outboard motor of claim 2 additionally comprising an intake pressure sensor and an intake temperature sensor, wherein the controller is configured to detect the amount of air flowing through the induction system with the intake pressure sensor and the intake temperature sensor.

5. The outboard motor of claim 1, wherein the amount of vapor allowed to enter the air induction system depends on engine speed.

6. The outboard motor of claim 1 additionally comprising a mounting assembly configured to support the outboard motor relative to an aft end of a watercraft, and to allow the outboard motor to be tilted relative to the watercraft, wherein the valve is positioned so as to remain above the vapor separator when the outboard motor tilted.

7. The outboard motor of claim 6, wherein the valve is positioned so as to remain above the vapor separator when the outboard motor is tilted to a maximum tilted-up position.

8. The outboard motor of claim 1, wherein the valve is positioned at a rearward portion of the vapor separator.

9. An outboard motor comprising a cowling, an engine positioned within the cowling, the engine comprising a generally vertically extending crankshaft and an engine body comprising a combustion chamber, an air induction system, a fuel system configured to provide fuel for combustion in the combustion chamber, the fuel system including a vapor separator, the vapor separator including at least one conduit connected to a valve and configured to vent vapor to the air induction system through the valve, a mounting assembly configured for supporting the outboard motor relative to an aft end of a watercraft and to allow the outboard motor to be tilted relative to the watercraft, and means for maintaining the valve at a position higher than the vapor separator when the outboard motor is tilted to a maximum tilted-up position.

* * * * *